US007722271B1

(12) United States Patent
Harvin

(10) Patent No.: US 7,722,271 B1
(45) Date of Patent: May 25, 2010

(54) FINGER ATTACHABLE WRITING APPARATUS

(76) Inventor: Gregory L. Harvin, 518 Sycamore Cir., San Bernardino, CA (US) 92410

( * ) Notice: Subject to any disclaimer, the term of this patent is extended or adjusted under 35 U.S.C. 154(b) by 1134 days.

(21) Appl. No.: 11/355,352

(22) Filed: Feb. 17, 2006

(51) Int. Cl.
*A46B 5/02* (2006.01)

(52) U.S. Cl. ..... 401/8; 401/6; 401/158; 15/443

(58) Field of Classification Search ..... 401/6–8, 401/158, 163, 164, 171–175, 152, 176, 153; 15/437, 443
See application file for complete search history.

(56) References Cited

U.S. PATENT DOCUMENTS

| | | | | | |
|---|---|---|---|---|---|
| 361,535 | A | * | 4/1887 | Merrick | 401/8 |
| 372,903 | A | * | 11/1887 | Forster | 401/7 |
| 1,902,811 | A | * | 3/1933 | Bienenstein | 401/174 |
| 1,903,022 | A | * | 3/1933 | Bassett | 401/174 |
| 2,509,837 | A | | 5/1950 | Nrzawa | |
| 2,572,476 | A | * | 10/1951 | Harbison | 401/174 |
| 3,887,286 | A | | 6/1975 | Bucey | |
| D246,904 | S | | 1/1978 | MacIntosh | |
| 4,332,178 | A | * | 6/1982 | Vukich | 401/8 |
| 4,738,556 | A | * | 4/1988 | Brown | 401/7 |
| 5,314,260 | A | | 5/1994 | Anderson | |
| 5,405,206 | A | * | 4/1995 | Bedol | 401/7 |
| 5,868,509 | A | | 2/1999 | Crutcher | |
| 5,885,018 | A | * | 3/1999 | Sato | 401/8 |
| 5,971,642 | A | * | 10/1999 | O'Mara et al. | 401/8 |
| 6,136,352 | A | * | 10/2000 | Silverstein et al. | 426/115 |
| 6,648,537 | B1 | * | 11/2003 | Park | 401/7 |
| 6,758,619 | B1 | * | 7/2004 | Yeh | 401/174 |

* cited by examiner

*Primary Examiner*—David J. Walczak
*Assistant Examiner*—Keegan Gumbs

(57) ABSTRACT

A finger attachable writing apparatus includes a housing with a top wall, a bottom wall and a peripheral wall that is attached to and extends between the top and bottom walls. The housing has a first end and a second end. A conduit is coupled to and is angled downwardly from the bottom wall. An aperture extends into a free end of the conduit and into an interior of the housing. A finger engaging member is attached to the housing and is configured to releasably attach the housing to a finger. An ink dispensing assembly is mounted in the housing. The ink dispensing assembly is positionable in a deployed position extending outwardly of the conduit or in a stored position. The ink dispensing assembly is configured to dispense ink from the conduit when in the deployed position.

4 Claims, 5 Drawing Sheets

FINGER ATTACHABLE WRITING APPARATUS

BACKGROUND OF THE INVENTION

1. Field of the Invention

The present invention relates to writing devices and more particularly pertains to a new writing device for attaching to a finger to allow a person to write without gripping a writing utensil.

2. Description of the Prior Art

The use of writing devices is known in the prior art. However, these devices have limitations, such as the angle at which they can be used and cannot be used by those persons having limited gripping abilities. Therefore, while these devices fulfill their respective, particular objectives and requirements, the need remains for a device that can be attached to a finger for easy use and should include an ink dispensing system that is not dependent upon the angle of the device as it is being used.

SUMMARY OF THE INVENTION

The present invention meets the needs presented above by generally comprising a housing that includes a top wall, a bottom wall and a peripheral wall that is attached to and extends between the top and bottom walls. The housing has a first end and a second end. A conduit is coupled to and is angled downwardly from the bottom wall. An aperture extends into a free end of the conduit and into an interior of the housing. A finger engaging member is attached to the housing and is configured to releasably attach the housing to a finger. An ink dispensing assembly is mounted in the housing. The ink dispensing assembly is positionable in a deployed position extending outwardly of the conduit or in a stored position. The ink dispensing assembly is configured to dispense ink from the conduit when in the deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
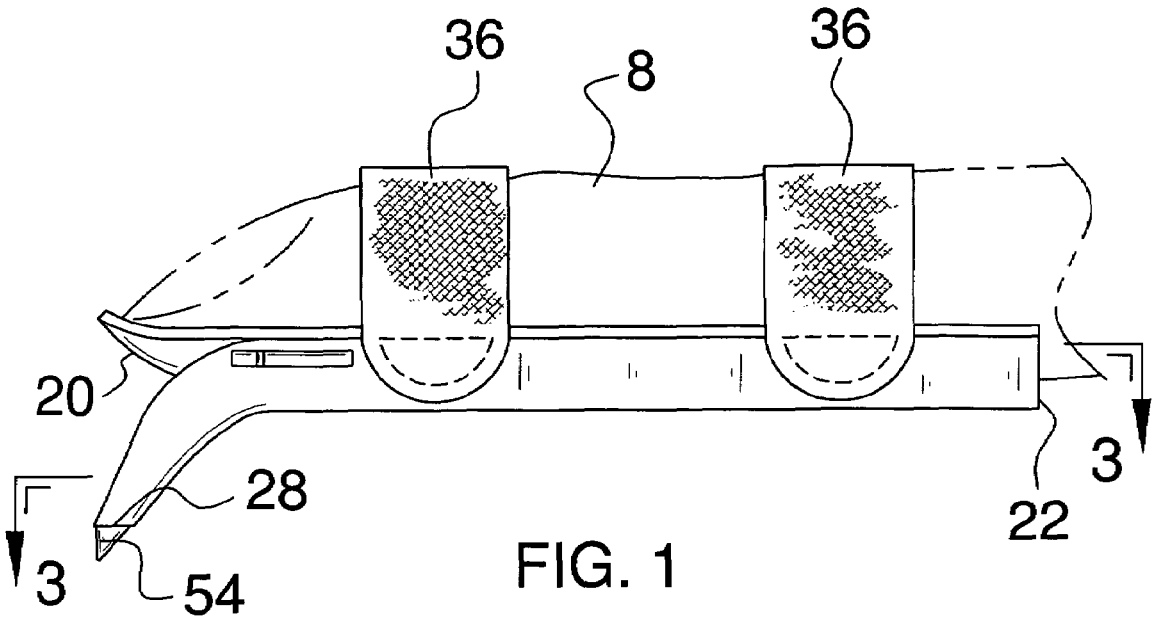
FIG. 1 is a side in-use view of a finger attachable writing apparatus according to the present invention.
Figure 2:
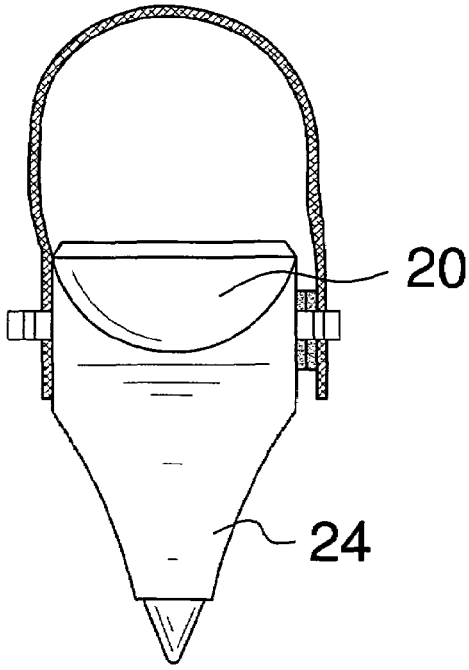
FIG. 2 is a front view of the present invention.
Figure 3:
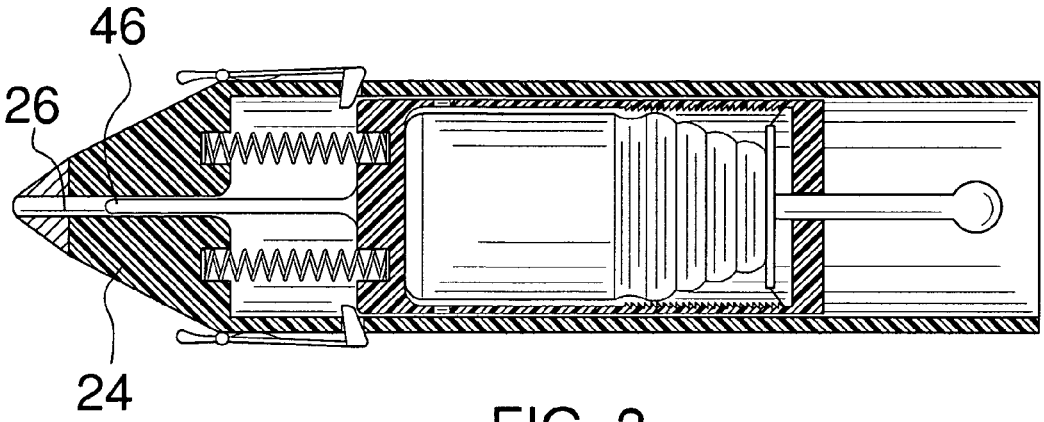
FIG. 3 is a cross-sectional view taken along line 3-3 of FIG. 1 of the present invention.
Figure 4:
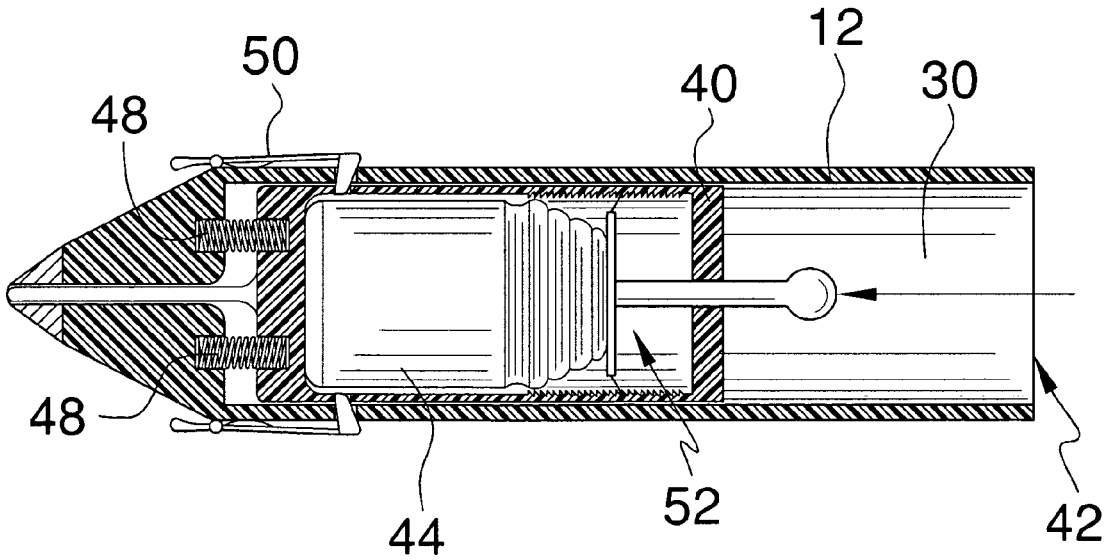
FIG. 4 is a cross-sectional view of the present invention.
Figure 5:
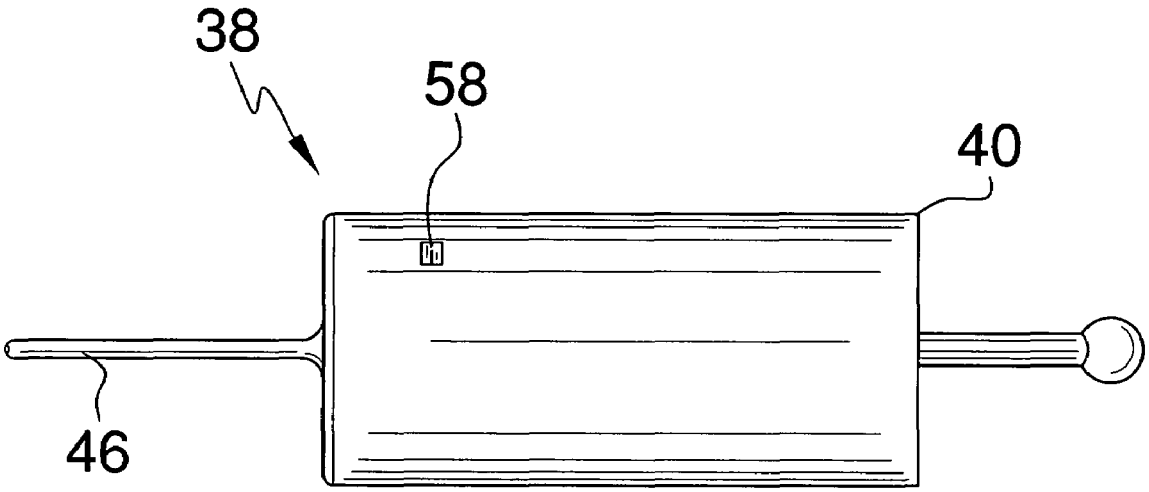
FIG. 5 is a side view of a sleeve and ink cartridge of the present invention.
Figure 6:
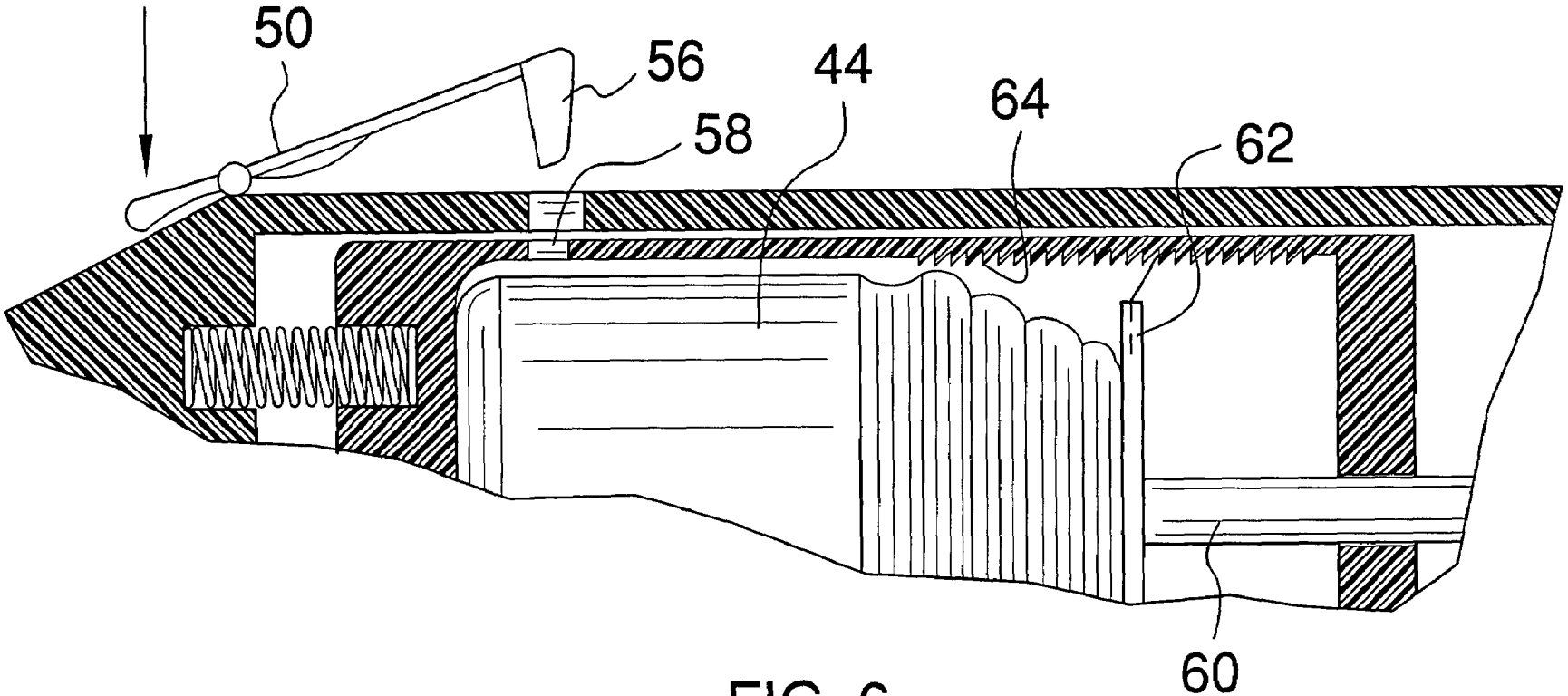
FIG. 6 is an enlarged cross-sectional view of the present invention.
Figure 7:
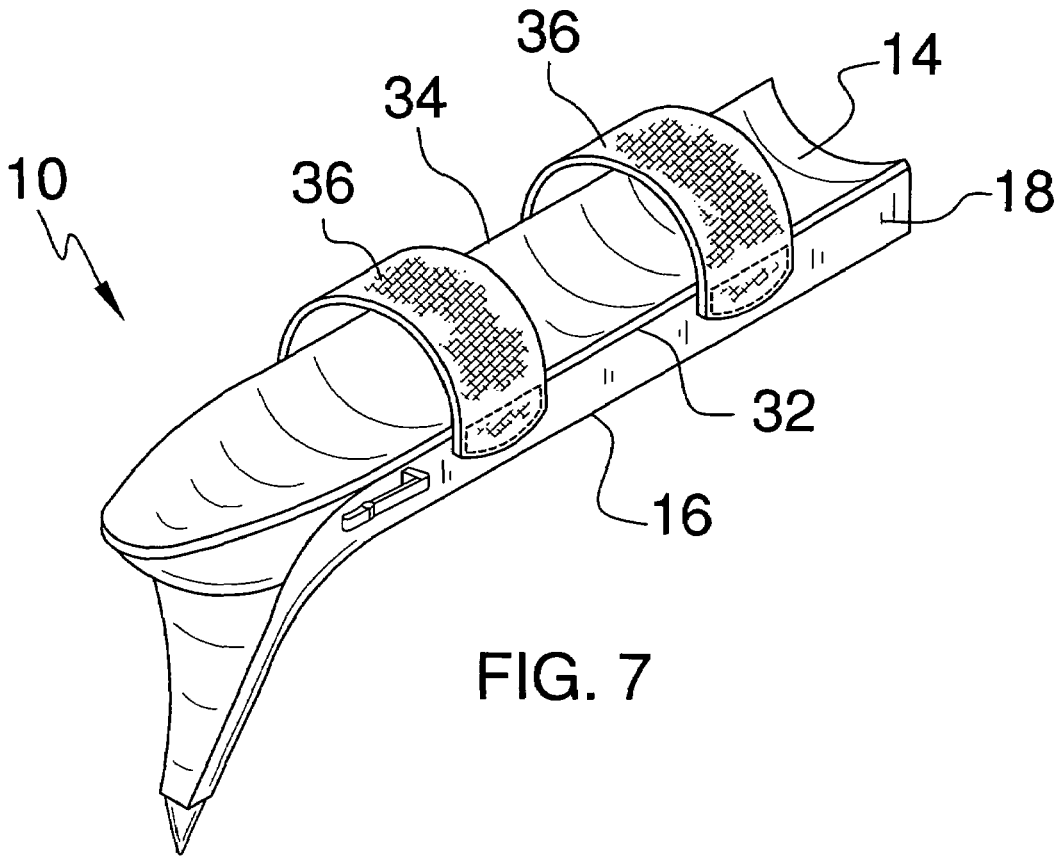
FIG. 7 is a top peripheral view of the present invention.

With reference now to the drawings, and in particular to FIGS. 1 through 8 thereof, a new writing device embodying the principles and concepts of the present invention and generally designated by the reference numeral 10 will be described.

As best illustrated in FIGS. 1 through 8, the finger attachable writing apparatus 10 generally comprises a housing 12 that has a top wall 14, a bottom wall 16 and a peripheral wall 18 that is attached to and extends between the top 14 and bottom 16 walls. The housing 12 has a first end 20 and a second end 22. A conduit 24 is coupled to and is angled downwardly from the bottom wall 16. An aperture 26 extends into a free end 28 of the conduit 24 and into an interior 30 of the housing 12. The top wall 14 has a concave outer surface from a first lateral edge 32 to a second lateral edge 34 of the top wall 14.

A finger engaging member 36 is attached to the housing 12 and is configured to releasably attach the housing 12 to a finger 8. The finger engaging member 36 includes at least two resiliently stretchable straps that are attached to and extends between the first 32 and second 34 lateral edges.

An ink dispensing assembly 38 is mounted in the housing 12. The ink dispensing assembly 38 is positionable in a deployed position extending outwardly of the conduit 24 or in a stored position. The ink dispensing assembly 38 is configured to dispense ink from the conduit 24 when in the deployed position. The ink dispensing assembly 38 includes a sleeve 40 removably extendable through an opening 42 in the second end 22 of the housing 12. An ink cartridge 44 is mounted in the sleeve 40. A nib 46 is fluidly coupled to the ink cartridge 44 and extends outwardly from the sleeve 40. The nib 46 is positioned in the conduit 24 when the sleeve 40 is positioned within the housing 12. A biasing member 48 is positioned within the housing 12 and biases the sleeve 40 away from the conduit 24, to the stored position. The biasing member 48 preferably includes one or more springs mounted in the housing 12. A securing member 50 is attached to the housing 12 and releasably secures the sleeve 40 in the deployed position. An urging member 52 extends into the sleeve 40 opposite of the nib 46 and is configured to urge a compressible portion of the ink cartridge 44 toward the nib 46 at selectable increments.

Figure 8:
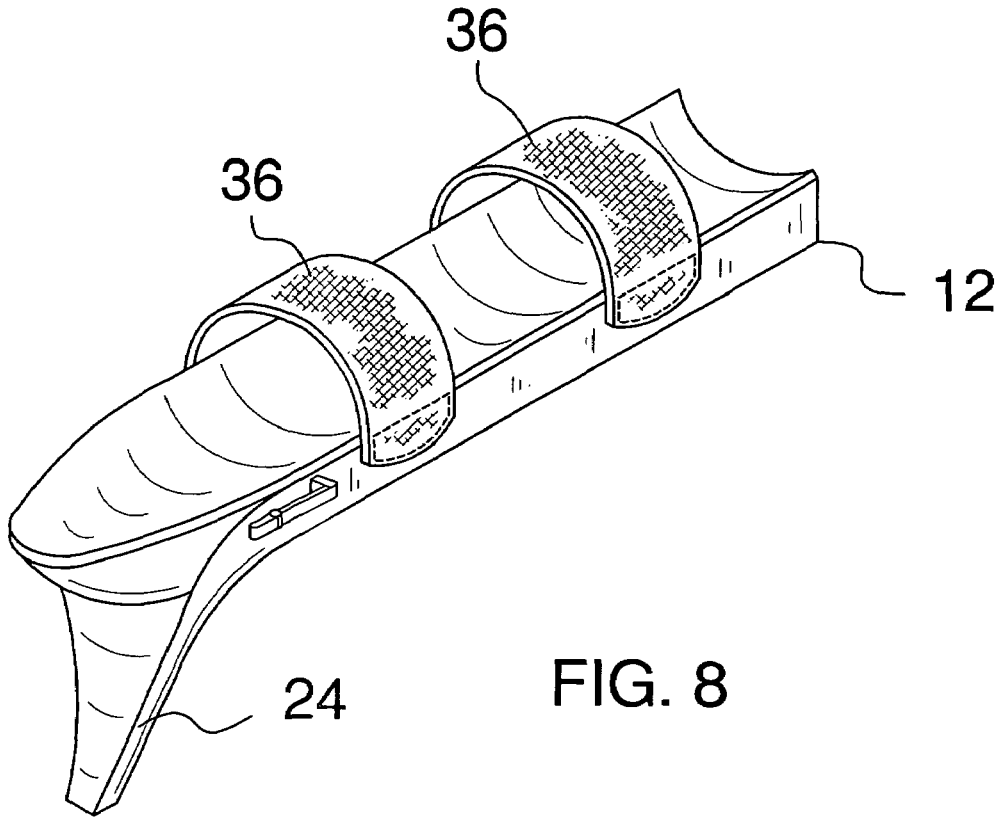
FIG. 8 is a top peripheral view of a second embodiment of the present invention.

A tip 54 may be attached to a free end 28 of the conduit 24 for assisting in the formation of a uniform line. The tip 54 may comprise an absorptive material. FIG. 8 shows a second version not including a tip 54.

In use, the housing 12 is attached to a person's finger 8 as shown in FIG. 1. The nib 46 is deployed by pushing the sleeve 40 forward so that the nib 46 is adjacent to or protrudes from the aperture 26. The securing member 50 includes one or more arms having catches 56 thereon which extend through the housing 12 and into notches 58 in the sleeve 40. When little ink is being discharged, the urging member 52, which comprises a rod 60 attached to a plate 62, is moved toward the conduit 24 to force the ink out of the ink cartridge 44. The urging member 52 allows the nib 46 to be used at any angle. The sleeve 40 includes internal locking teeth 64 for securing the plate 62 at a selected position. The securing member 50 may be released to allow the nib 46 to move away from the aperture 26 and for removing the sleeve 40 for replacement with a full ink cartridge 44.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A finger mountable writing apparatus for removably attaching to a finger, said apparatus comprising:

a housing having a top wall, a bottom wall and a peripheral wall being attached to and extending between said top and bottom walls, said housing having a first end and a second end, a conduit being coupled to and being angled downwardly from said bottom wall, an aperture extending into a free end of said conduit and into an interior of said housing, said top wall has a concave outer surface from a first lateral edge to a second lateral edge of said top wall;

a finger engaging member being attached to said housing and being configured to releasably attach said housing to the finger; and an ink dispensing assembly being mounted in said housing, said ink dispensing assembly being positionable in a deployed position extending outwardly of said conduit or in a stored position, said ink dispensing assembly being configured to dispense ink from said conduit when in said deployed position, said ink dispensing assembly including;

a sleeve removably extendable through an opening in said second end of said housing;

an ink cartridge being mounted in said sleeve;

a nib being fluidly coupled to said ink cartridge and extending outwardly from said sleeve, said nib being positioned in said conduit when said sleeve is positioned within said housing;

a biasing member being positioned within said housing and biasing said sleeve away from said conduit; and a securing member being attached to said housing and releasably securing said sleeve in said deployed position.

2. The apparatus according to claim 1, wherein said finger engaging member includes at least two resiliently stretchable straps being attached to and extending between said first and second lateral edges, said said straps traversing said top wall.

3. The apparatus according to claim 1, wherein said ink dispensing assembly further includes an urging member extending into said sleeve opposite of said nib and being configured urge a compressible portion of said ink cartridge toward said nib at selectable increments.

4. A finger mountable writing apparatus for removably attaching to a finger, said apparatus comprising:

a housing having a top wall, a bottom wall and a peripheral wall being attached to and extending between said top and bottom walls, said housing having a first end and a second end, a conduit being coupled to and being angled downwardly from said bottom wall, an aperture extending into a free end of said conduit and into an interior of said housing, said top wall having a concave outer surface from a first lateral edge to a second lateral edge of said top wall;

a finger engaging member being attached to said housing and being configured to releasably attach said housing to the finger, said finger engaging member including at least two resiliently stretchable straps being attached to and extending between said first and second lateral edges;

an ink dispensing assembly being mounted in said housing, said ink dispensing assembly being positionable in a deployed position extending outwardly of said conduit or in a stored position, said ink dispensing assembly being configured to dispense ink from said conduit when in said deployed position, said ink dispensing assembly including;

a sleeve removably extendable through an opening in said second end of said housing;

an ink cartridge being mounted in said sleeve;

a nib being fluidly coupled to said ink cartridge and extending outwardly from said sleeve, said nib being positioned in said conduit when said sleeve is positioned within said housing;

a biasing member being positioned within said housing and biasing said sleeve away from said conduit;

a securing member being attached to said housing and releasably securing said sleeve in said deployed position; and an urging member extending into said sleeve opposite of said nib and being configured urge a compressible portion of said ink cartridge toward said nib at selectable increments.

* * * * *